United States Patent [19]

Frank

[11] 4,346,785

[45] Aug. 31, 1982

[54] RAIL LUBRICATOR

[75] Inventor: Earl E. Frank, Tallman, N.Y.

[73] Assignee: Abex Corporation, New York, N.Y.

[21] Appl. No.: 133,337

[22] Filed: Mar. 24, 1980

[51] Int. Cl.[3] ..... B61K 3/00

[52] U.S. Cl. ..... 184/3 A

[58] Field of Search ..... 184/3 A, 3 R; 104/26

[56] References Cited

U.S. PATENT DOCUMENTS

| | | | |
|---|---|---|---|
| 1,839,427 | 1/1932 | Warr | 184/3 A |
| 1,940,527 | 12/1933 | Bolt | 184/3 A |
| 1,942,484 | 1/1934 | Merk | 184/3 A |
| 2,029,828 | 2/1936 | Mennie | 184/3 A |
| 2,055,140 | 9/1936 | Bates et al. | 184/3 A |
| 2,152,696 | 4/1939 | Huck | 184/3 A |
| 2,168,577 | 8/1939 | Overmier et al. | 184/3 A |
| 2,220,716 | 11/1940 | Hetsch | 184/3 A |
| 2,231,394 | 2/1941 | Reece | 184/3 A |
| 2,262,852 | 11/1941 | Martin | 184/3 A |
| 2,355,241 | 8/1944 | Rodman et al. | 184/3 A |

*Primary Examiner*—Sal Cangialosi

*Attorney, Agent, or Firm*—Kinzer, Plyer, Dorn & McEachran

[57] ABSTRACT

A rail lubricator system for applying lubricant to the flange of a railroad car wheel riding on the head of a rail. The system has a lubricant reservoir with pumps therein for supplying lubricant to a delivery assembly attached to a rail. The pumps are mounted on a support which is connected to the reservoir cover. The lubricant delivery assembly clamps to a rail without the need for bolts or bolt holes extending through the rail web.

14 Claims, 13 Drawing Figures

96
98
100
102
104
106
108
110
112
113
114
116
118
120
122
124
126
128
130
132
134
30
32
34
36

RAIL LUBRICATOR

SUMMARY OF THE INVENTION

This invention relates to rail lubricators which apply lubricant to the flange of a railroad car wheel riding on the head of a rail. Such systems are used to apply lubricant or grease at the entrance of a curve for the purpose of reducing railwear, flange wear and noise, as the car travels through the curve. Utilization of such systems in the past has been hampered by high installation costs and maintenance problems. In particular, the portion of the system which applies the grease to the wheel flange, the so-called delivery assembly, has been fastened to the rail by bolting through the rail web. This requires either a special, pre-drilled rail, or field drilling of bolt holes. If the track is made with welded rail the problems of inserting a special, pre-drilled rail section make installation even more troublesome.

Another difficulty with present lubricator systems is the need for polymer seals in the delivery assembly. Such seals are used in the parts which define the lubricant ports but they are subject to deterioration due to aging, weather and related environmental factors. Seal failure can lead to uneven application of the lubricant. Another drawback of present systems is maintenance of the lubricant pumps. These pumps are mounted in the bottom of the lubricant reservoir which is buried in the wayside area of the track. This limits access to the pumps for performing maintenance work, such as cleaning the pump input screens, and maintenance is a messy, dirty job besides. Also, refilling the lubricant reservoir in its buried position requires great care to prevent introduction of dirt or other foreign matter into the reservoir.

It is an object of the present invention to avoid the above difficulties by providing a rail lubricator system which is readily installed and easily maintained. In furtherance of this objective, the present invention provides a lubricator delivery assembly which clamps onto a rail without the need for bolts or bolt holes extending through the rail web. Instead the delivery assembly clamps on to the rail with a tightening bolt extending underneath the rail base. The lubricator delivery ports are defined by channels in the face of a delivery bar, the face having a milled surface. A cover plate encloses the channels while defining delivery ports at the top edge of the delivery bar. The delivery bar face and cover plate form a metal-to-metal seal which eliminates the need for any polymer seals.

The present invention further includes a lubricant reservoir cover assembly having a depending support frame which carries the lubricant pumps. The pumps can be removed from the reservoir by taking off the cover assembly. The lubricant supply is replenished by removing the empty lubricant drum and replacing it with a full one. The cover assembly including the pumps is then placed back on the full drum to make the system ready for use.

This arrangement of pump supports and clamp-on delivery assemblies affords a modular design which allows installation of as many lubricators as desired. Additional pumps can be readily installed on the support frame and corresponding delivery assemblies can be added to the rail. Thus a single design for the reservoir cover assembly and delivery assembly can be used to accommodate a range of application rates.

DETAILED DESCRIPTION OF THE INVENTION

Figure 1:
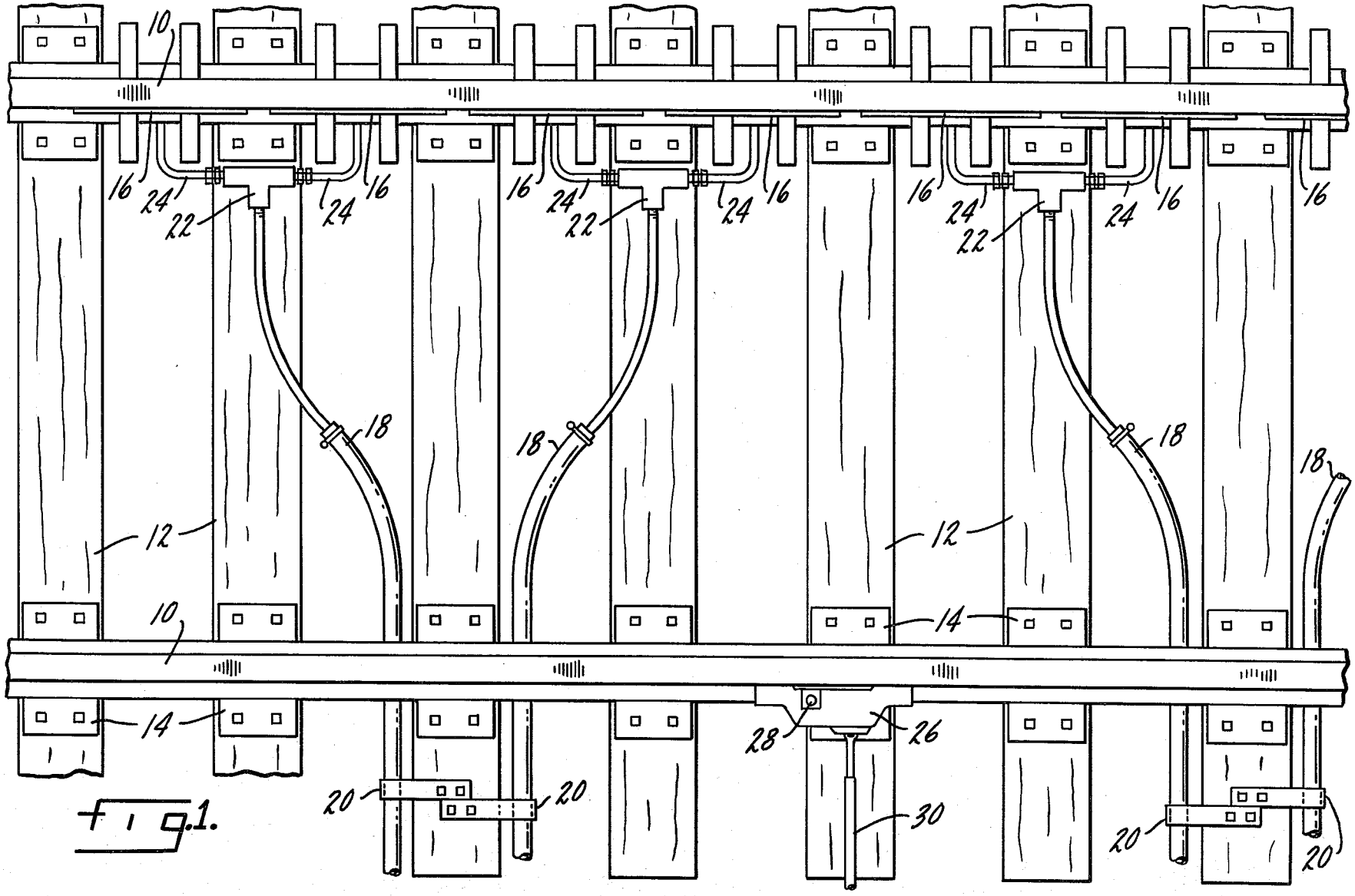
FIG. 1 is a plan view of a track section showing a plurality of delivery assemblies and the pump drive unit.

FIG. 1 shows portions of a rail lubricator system installed on a railroad track. The track comprises rails 10 attached to a plurality of ties 12 by tie plates 14. The rail lubricator system may include a plurality of lubricant delivery assemblies 16. The delivery assemblies 16 receive lubricant through a lubricant conduit, as at 18. The conduits may be secured to one or more ties by clips 20. The conduits are connected at one end to a lubricant reservoir and at the other end to a T-fitting 22. The T-fittings have internal divider fins which divide the lubricant flow into a pair of branches 24. Each branch supplies a single delivery assembly.

The lubricant is forced through the conduit 18 by one or more pumps in the lubricant reservoir. These pumps are operated by a pump drive unit 26 mounted near a rail 10. The drive unit has a plunger 28 which is actuated by the tread of passing railroad car wheels. A one-way clutch inside the drive unit housing converts the linear motion of the plunger 28 into rotational motion which turns a torque rod 30. The torque rod 30 drives the lubricant pumps by way of connections which will be shown below.

Figure 2:
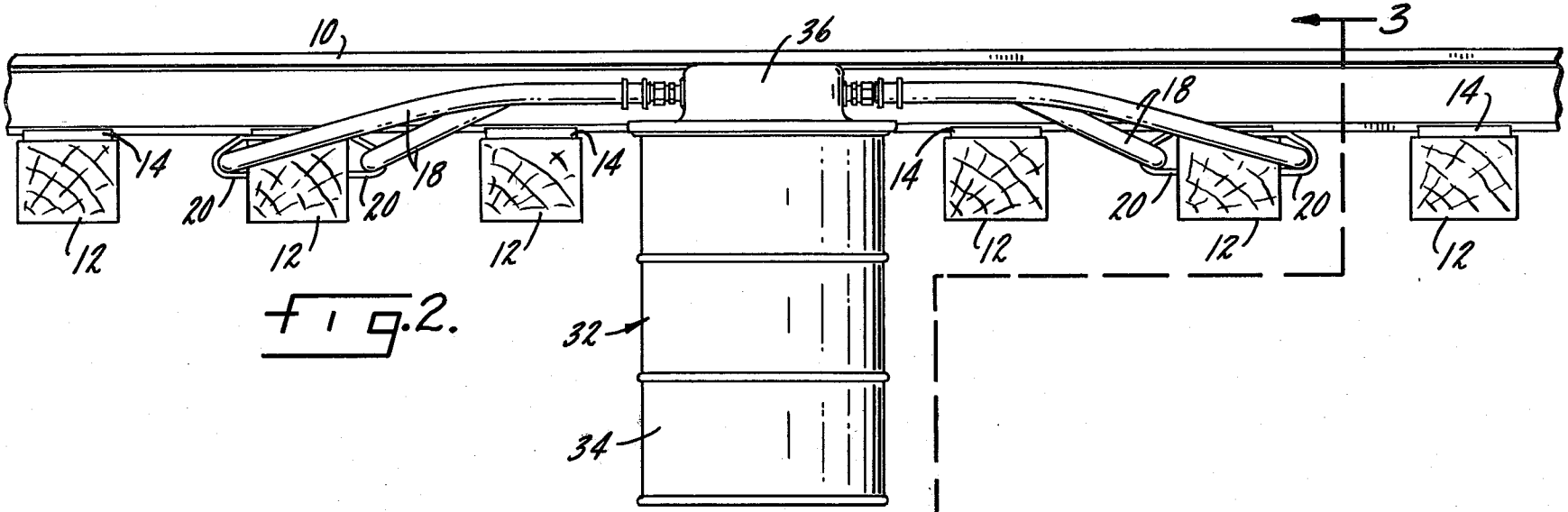
FIG. 2 is a side elevation view from the field side of the track, showing the lubricant reservoir and the reservoir cover assembly in place.
Figure 3:
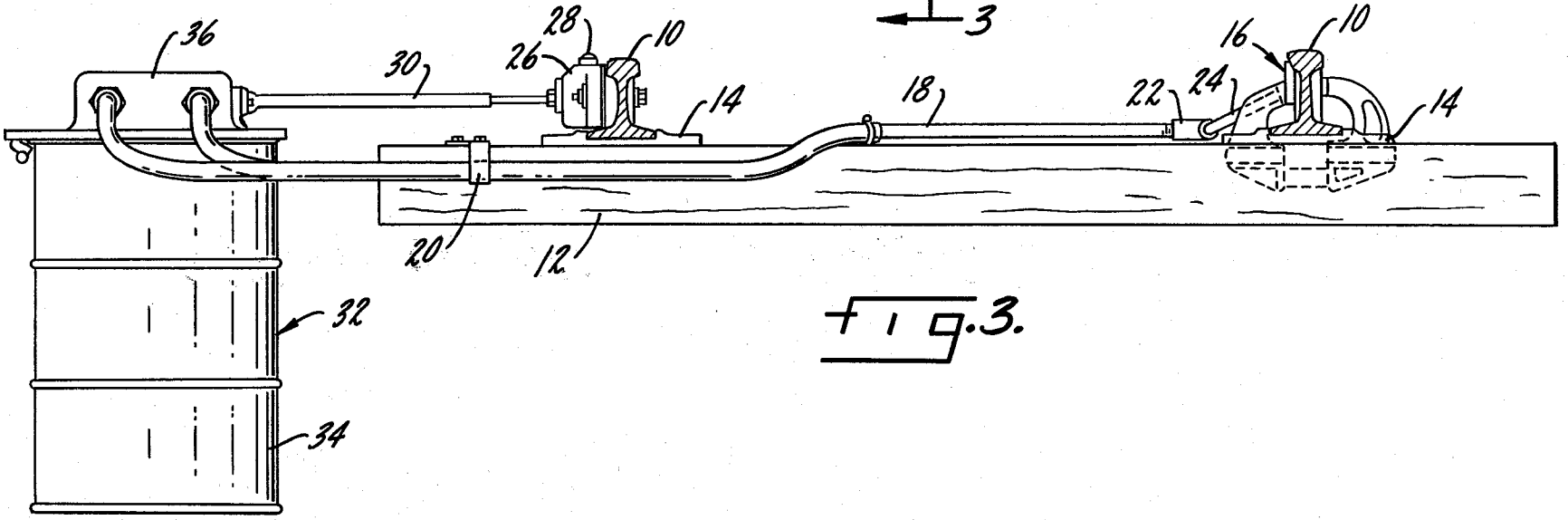
FIG. 3 is an elevation view taken along line 3—3 of FIG. 2.

FIG. 2 shows the lubricant reservoir 32 which is preferably buried alongside of the track on the field side. The reservoir includes a drum 34 and a removable cover assembly 36. As seen in FIG. 3, the torque rod 30 extends to and is supported by the cover assembly 36. The lubricant conduits 18 also connect to the cover assembly.

Figures 4, 5, 6:
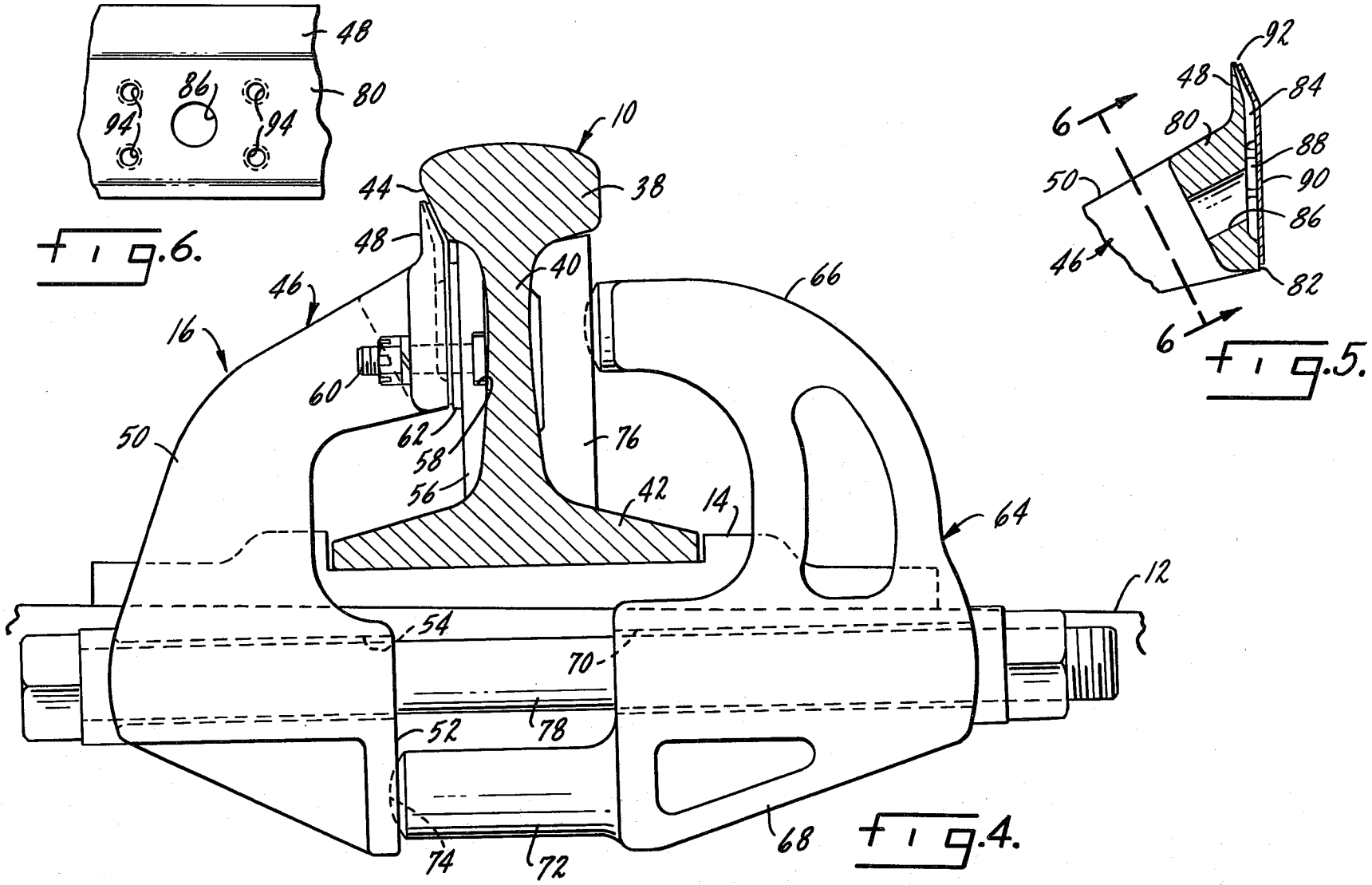
FIG. 4 is an elevation view of a lubricant delivery assembly according to the present invention.
FIG. 5 is a side elevation view of a delivery bar, showing a section through the middle of the bar.
FIG. 6 is a section taken along line 6—6 of FIG. 5.

The details of lubricant delivery assembly 16 are shown in FIG. 4. The delivery assembly is designed to clamp onto a rail 10. The rail 10 has the usual configuration including a head 38, a web 40 and a base 42. The gauge side of the head 38 may have an undercut 44, the purpose of which will be explained below. The delivery assembly itself comprises a first member 46. This member includes an elongated, generally vertical lubricant delivery bar 48. The first member 46 also has at least one arm 50 attached to the delivery bar 48 and depending therefrom. In a preferred embodiment the first member has two arms 50. The arms extend to a point below the rail base 42 and terminate in an enlarged shoulder portion 52. The shoulder 52 has an opening 54 extending through it.

A first spacer or D-bar 56 is attached to the delivery bar 48. The spacer or D-bar contacts the rail web 40 and a portion of the head 38 and base 42. The spacer can be sized according to the dimensions of a particular rail. This permits application of a standard-sized first member 46 to the various rail sizes. The D-bar has a notch or undercut 58 which permits the head of a connecting bolt 60 to lie flush with the inside surface of the D-bar. The spacer positions the first member 46 such that the delivery bar 48 is mounted underneath the undercut 44 of the rail head. The undercut permits the mounting of the delivery bar near the top of the rail head while maintaining clearance between the delivery bar and the path of the wheel flanges. Further adjustment of the delivery bar position can be obtained by use of shims such as at 62 interposed between the delivery bar 48 and D-bar 56.

A second member 64 of the delivery assembly 16 engages the field side of the rail 10. The second member 64 has at least one arm 66 extending to a point below the rail base and terminating at an enlarged shoulder portion 68. The shoulder 68 is in facing relation with the shoulder 52 on the first member 46. There is an opening 70 through the shoulder portion 68 of the second member 64. This opening 70 is in line with the opening 54 in the first member 46. The shoulder 68 of the second member further includes a laterally projecting lug 72. The lug 72 has a rounded end which engages an indentation 74 in the shoulder of the first member. In a preferred embodiment the second member engages a second spacer or D-bar 76 rather than contacting the rail directly. This has the advantage mentioned above that a standard-sized member can be universally applied to all of the various rail sizes by supplying an appropriate D-bar.

Tightening means in the form of a tightening bolt 78 extends through the openings 54 and 70 in the shoulders of the first and second members 46 and 64. The tightening means is located so as to urge the arms of the first and second members into clamping engagement with the rail. Thus with the bolt 78 located between the lug 72 and the rail base 42 moments are applied to the first and second members which urge the upper extremities of those arms into engagement with the rail.

In a preferred embodiment both the first and second members 46 and 64, respectively, are one-piece castings. FIGS. 5–8 show some of the details of the first member casting and the delivery assembly. In addition to the delivery bar 48 and the arm 50, the first member has a central portion 80 to which the branch of the lubricant conduit connects. The delivery bar 48 has a face 82. Formed in the face are lubricant channels 84. An entry passage 86 extends through the central portion 80 and opens out on the face of the delivery bar into a channel 88. A cover plate 90 is attached to the face of the delivery bar. The cover plate may be attached to the delivery bar by epoxy glue or other suitable attachment method. The cover plate encloses the channels in the face of the delivery bar so as to form lubricant passages. These passages are fully sealed except at the upper edge of the delivery bar. The channel 84 terminates just at the edge of the cover plate 90 so as to form delivery ports 92. These are the points where lubricant is released onto the wheel flange.

FIG. 6 is another view of a portion of the delivery bar. The central portion 80 has a plurality of bolt holes 94 for connection of a fitting on the lubricant supply conduit.

Figure 7:
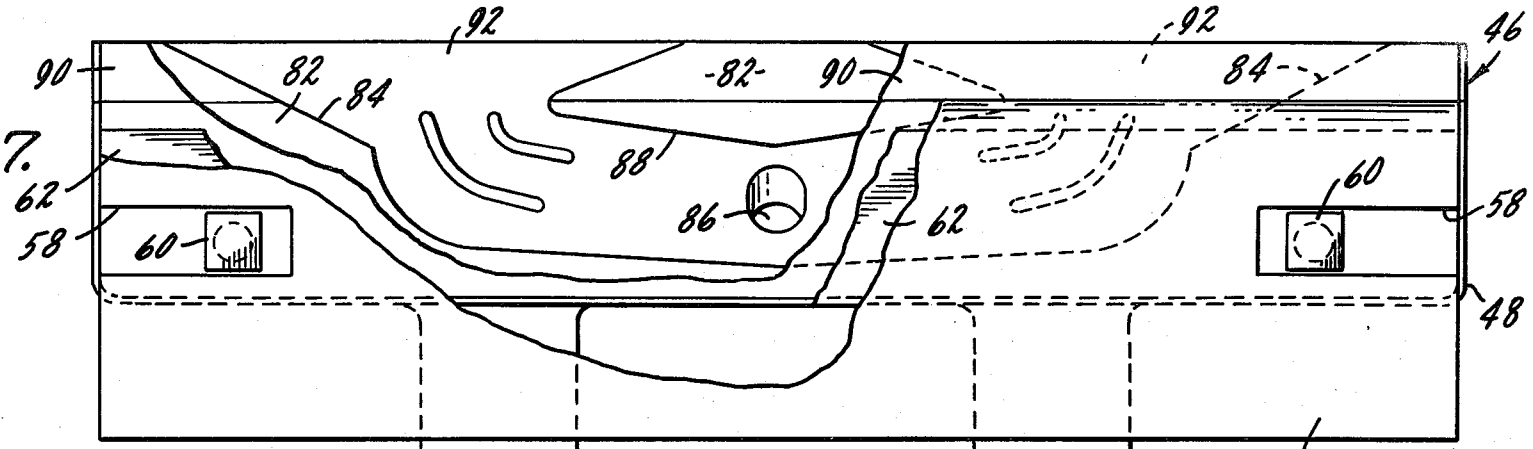
FIG. 7 is a front elevation view of a delivery assembly with portions cut away.
Figure 8:
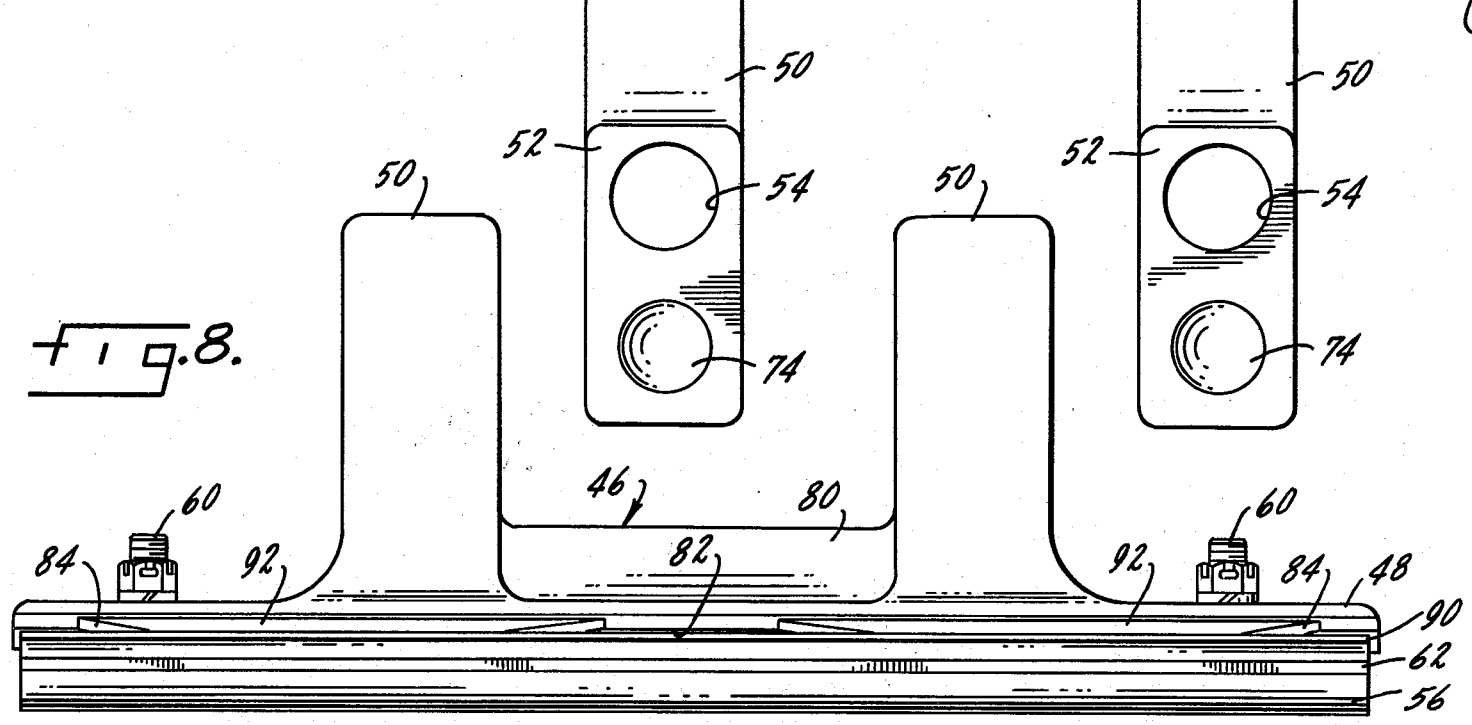
FIG. 8 is a top plan view of the delivery bar.

FIGS. 7 and 8 show alternate views of the first member 46 together with the cover plate 90 and the first spacer or D-bar 56. It will be noted that the cover plate fits directly on the face of the delivery bar. The face is a milled surface so a tight joint can be obtained. This eliminates the need for elastomeric seals.

Figures 9, 10:
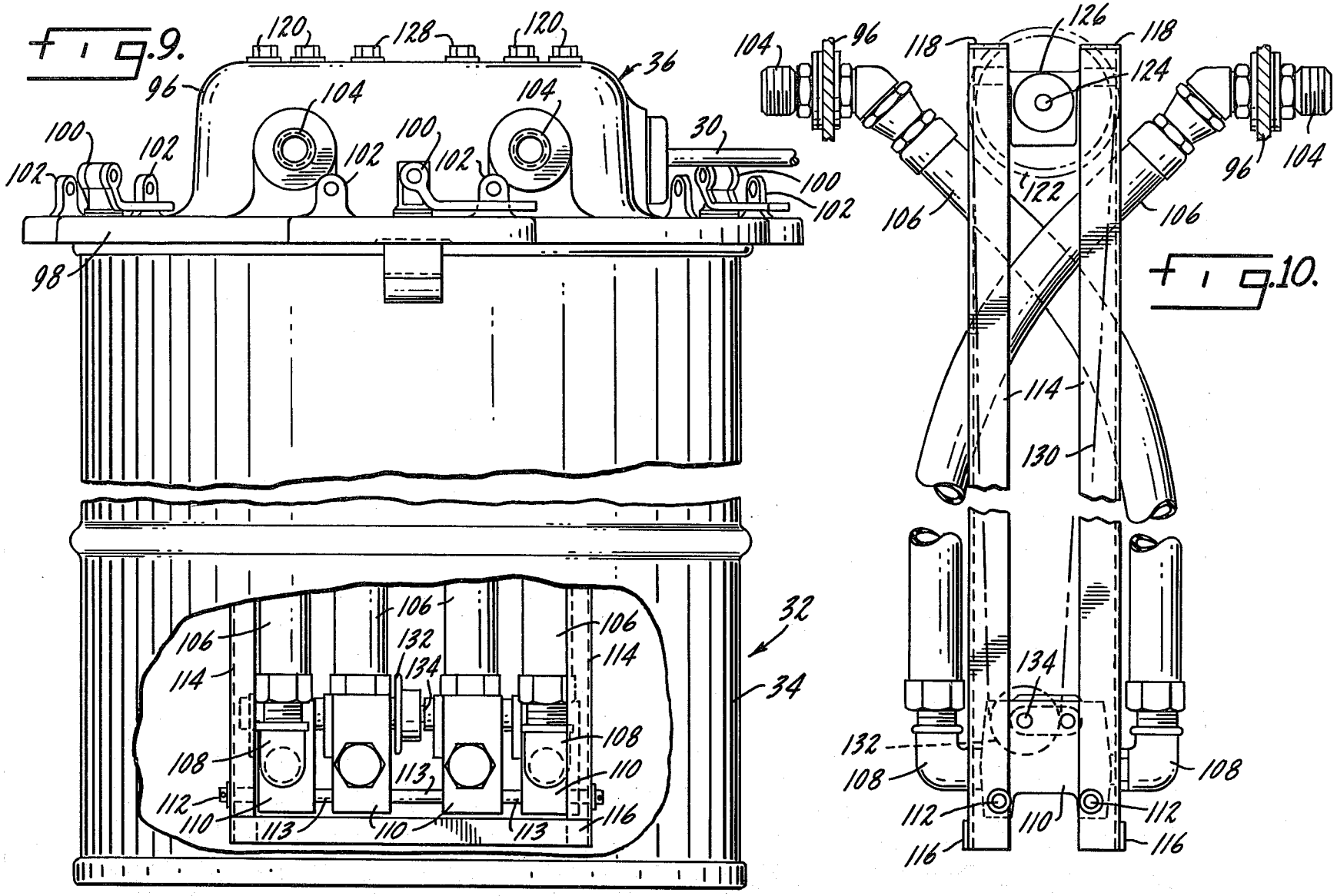
FIG. 9 is an elevation view of the lubricant reservoir with portions cut away to show the pump mounting.
FIG. 10 is a side elevation view showing the pump support frame and the pump drive connections together with the interior lubricant hoses.

FIGS. 9 and 10 show the lubricant reservoir 32 and its associated pump supports and pump drive connections. The lubricant reservoir cover assembly 36 has a dome portion 96 and a lid portion 98. The lid is held on the reservoir drum 34 by a plurality of clamps 100. Each clamp has a pair of retainer lugs 102 to which the clamp handle may be secured. The dome 96 of the cover assembly has a plurality of openings which include fittings or unions 104 for connection of the lubricant conduits. Inside the cover the unions 104 connect to hoses 106. The hoses extend to the bottom of the reservoir where they are connected by elbows 108 to the output of the lubricant pumps. The pump themselves are shown at 110. They may be gear pumps, suitable for use in pumping grease impregnated with messy graphite. In the embodiment shown in FIGS. 9 and 10 there are four lubricant pumps but it will be understood that there could be a different number depending on the number of delivery assemblies needed. The pumps 110 are held in place by retainer rods 112. There are spacer sleeves 113 on the retainer rods 112 to hold the pumps in position on the rods. The retainer rod ends are held in a support frame which includes vertical members 114, bottom horizontal members 116 and mounting plates 118 (FIG. 10). The entire support frame is fastened to the top of the dome portion 96 of the cover assembly 36. Support frame bolts 120 (FIG. 9) extend through the mounting plates 118 of the support frame to secure the frame to the cover assembly. Thus it can be seen that all the inner workings of the reservoir are attached to the cover assembly. Any maintenance work required for the pumps, or installation of additional pumps can be performed by releasing the cover clamps 100 and removing the cover assembly. The pumps 110 and hoses 106 are removed from the drum as a unit with the cover assembly and it is not necessary for anybody to be inside the drum to get at the pumps.

The rotational motion of the torque rod 30 is transmitted to the pumps by a chain drive. An upper drive sprocket 122 is mounted on a shaft 124 which in turn is connected to the torque rod 30. A shaft 124 is supported by a pair of pillow blocks 126 which are fastened to the top of the dome 96 by bolts 128. A chain, shown schematically at 130 in FIG. 10, drives a lower sprocket 132. The sprocket 132 is fixed on a pump drive shaft 134. The shaft 134 is a common drive shaft for all of the pumps 110.

Figure 11:
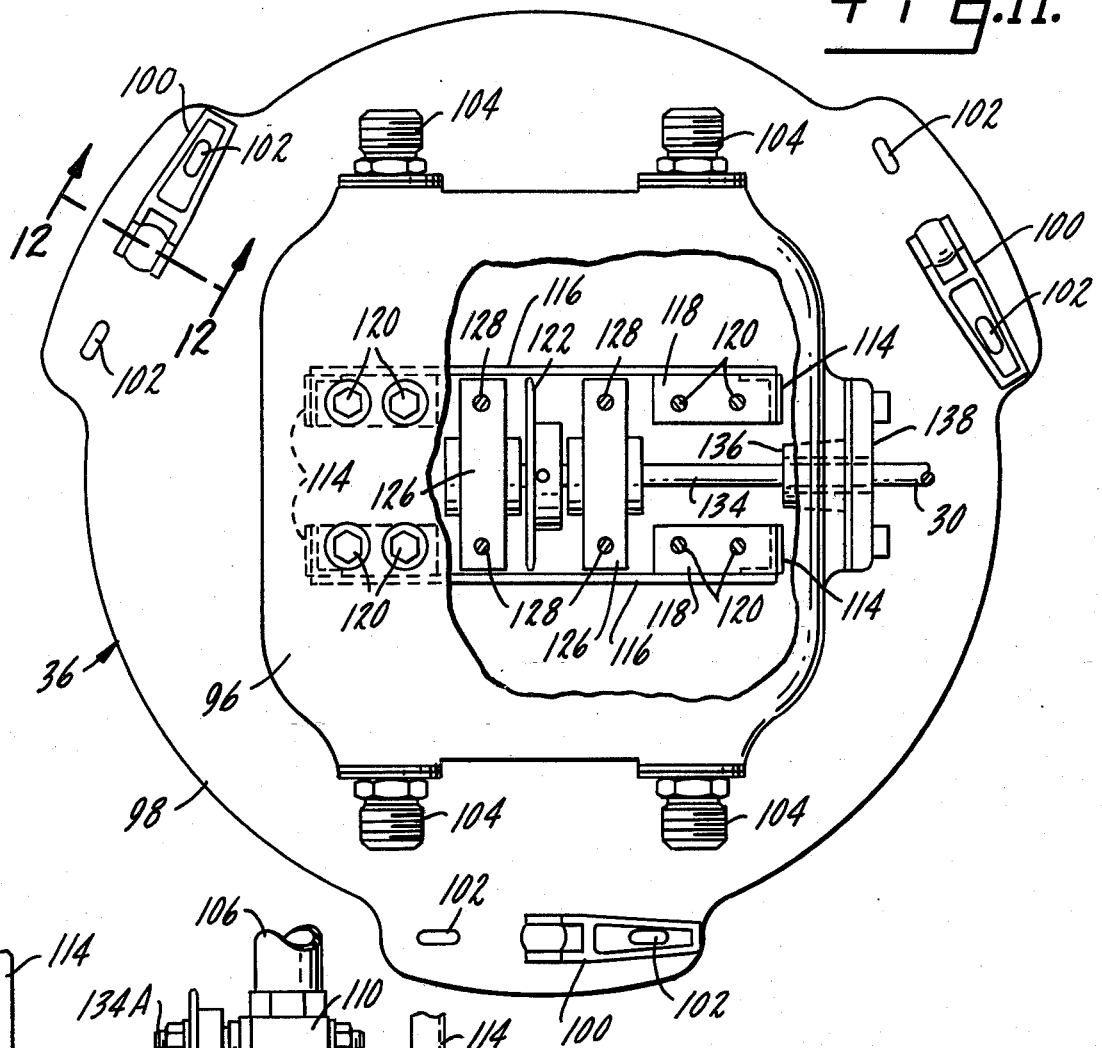
FIG. 11 is a top plan view of the reservoir cover assembly with a portion cut away.

FIG. 11 shows the connection between the torque rod 30 and the upper drive shaft 124. A coupler 136 is provided just inside the dome 96. The torque rod 30 can be disconnected by removing the fitting 138.

Figure 12:
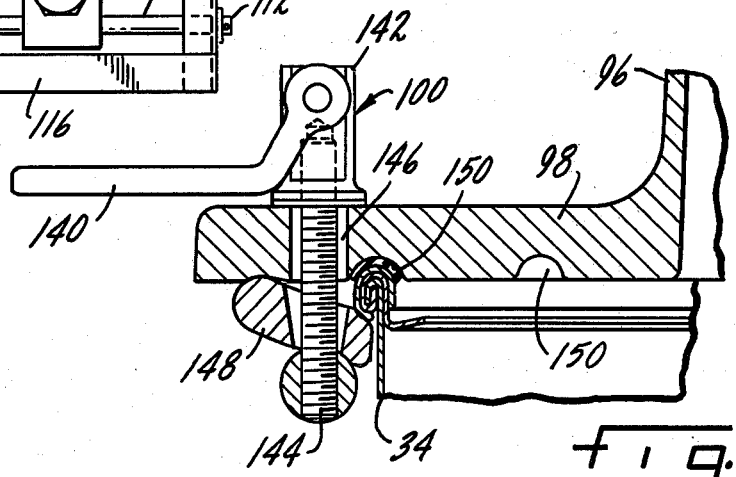
FIG. 12 is a section taken along line 12—12 of FIG. 11.

Details of the clamp 100 are shown in FIG. 12. The clamp includes a handle 140 pivotally connected to a cap 142. The cap contains a bolt 144 which extends through a hole 146 in the lid 98. A retaining band 148 engages the rim of the drum 34 and urges it into sealing relation with an annular groove 150. The lid 98 is provided with two grooves to accommodate different drum sizes.

Figure 13:
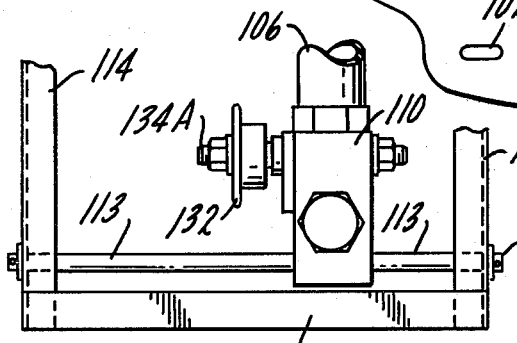
FIG. 13 is an elevation view showing a lubricant pump and its mounting.

As stated above the present invention can be utilized with different numbers of lubricant pumps. FIG. 13 shows the mounting of a single pump at the bottom of the support frame. The single pump unit utilizes a forshortened drive shaft 134A. Also, the spacers on the retainer rod 112 would be different from the four pump unit shown in FIG. 9. And three of the unions in the dome would be plugged with a single pump set-up. Aside from these modifications, the reservoir is the same regardless of the number of pumps installed therein.

The use, operation and function of the invention are as follows:

When a railroad car passes the pump drive mechanism 26 the tread of the wheel depresses plunger 28 causing the torque rod 30 to rotate. The rotation of the torque rod is transferred to the upper drive shaft 124 which turns the sprocket 122, the chain 130 and the lower drive sprocket 132. When the lower sprocket rotates, the drive shaft 134 operates the pumps 110. The pumps force grease through the hoses 106 to the lubricant conduits 18. The lubricant passes through the T-fitting 22 and branches 24 to the central portion of a delivery assembly. The lubricant passes through the entry passage 86 into the channel 88 and through channels 84. The lubricant is applied to the wheel flange through port 92 on the top edge of the delivery bar.

When it is time to replenish the lubricant supply in the reservoir, the user releases the clamps 100 and removes the cover assembly 36. Since the support frame is attached to the cover assembly all the working parts of the system are removed therewith. There remains only the empty drum 34 which can be replaced with a new, full drum. The cover assembly is then replaced, the clamps tightened and the torque rod reconnected to the cover assembly. After the pumps are primed the system is again ready for use.

I claim:

1. In a rail lubricator system which applies lubricant to the flange of a railroad car wheel riding on the head of a rail, the rail also having a base and a web, a lubricant delivery assembly, a lubricant reservoir, a lubricant conduit connecting the reservoir and the delivery assembly, at least one pump for pumping lubricant from the reservoir through the conduit to the delivery assembly and a pump drive mounted near the rail such that passing car wheels actuate the drive which then operates the pump, the improvement comprising a delivery assembly having a force-multiplying clamp means including lower-portions extending under the base of a rail, and upper portions for applying a multiplied clamping force for holding the delivery assembly to the rail, and tightening means so engaged with said lower portions as to cause the upper portions to apply said multiplied force when the tightening means are tightened on said lower portions.

2. The structure of claim 1 wherein the delivery assembly comprises:

(a) a first member having a lubricant delivery bar engaging one side of the rail and at least one arm depending therefrom extending to a point below the rail base and terminating with an enlarged shoulder;

(b) a second member engaging the other side of the rail and having at least one arm extending to a point below the rail base, the arm terminating with an enlarged shoulder in facing relation with the shoulder of the first member;

(c) a laterally projecting lug on one shoulder; engagable with the other shoulder, the tightening means being located between the rail base and the lug so as to urge the upper portions of the arms of the first and second members into clamping engagement with the rail.

3. The structure of claim 2 further comprising:

(a) a first spacer attached to the delivery bar and engagable with said one side of the rail web; and (b) a second spacer attached to the second member and engagable with said other side of the rail web.

4. The structure of claim 2 wherein the shoulders of the first and second members have openings therein and the tightening means comprises a bolt fitting through the openings in the shoulders.

5. The structure of claim 2 wherein the first member is a one-piece casting.

6. The structure of claim 2 or 5 wherein the delivery bar has a milled face, the face having channels formed therein which extend to the top edge of the delivery bar, the delivery assembly further including a cover plate affixed to the face of the delivery bar, the plate enclosing the channels of the delivery bar face so as to form lubricant passages.

7. A lubricant delivery assembly for applying lubricant to the flange of a railroad car wheel riding on the head of a rail, the rail also having a base and a web, the assembly comprising:

(a) a delivery bar adapted to engage a rail beneath the rail head and having a milled face with channels formed therein; and (b) a cover plate affixed directly to the face of the delivery bar, enclosing the channels to form lubricant passages.

8. The structure of claim 7 wherein the channels extend to the edge of the delivery bar nearest the rail head so that the channel termination and cover plate form lubricant delivery port.

9. The structure of claim 7 wherein the delivery bar is a one-piece casting.

10. The structure of claim 7 further comprising a spacer attached to the delivery bar and adapted to engage the rail web such that the delivery bar is supported in spaced relation to the web.

11. A rail lubricator system which applies lubricant to the flange of a railroad car wheel riding on the head of a rail, comprising, a lubricant delivery assembly attached to the rail, a lubricant reservoir having a removable cover assembly, a lubricant conduit connecting the reservoir and the delivery assembly, a support frame in the reservoir, attached to the reservoir cover assembly and extending to a point near the bottom of the reservoir, at least one lubricant pump mounted on the support frame, the pump being suitable for pumping lubricant from the reservoir through the lubricant conduit to the delivery assembly, a pump drive shaft mounted on the support frame, said drive shaft being drivingly engageable with a plurality of lubricant pumps, and a pump drive unit mounted near a rail and operatively connected to the pump drive shaft such that passing car wheels actuated the drive unit which then operates the pump drive shaft.

12. The structure of claim 11 further including a plurality of pumps mounted at the bottom of the support frame, the pumps being driven by said common drive shaft.

13. The structure of claim 11 further comprising a union extending through the cover assembly and a hose inside the reservoir connecting the pump to the interior end of the union, the lubricant conduit being joined to the exterior end of the conduit.

14. The structure of claim 11 wherein the pump is mounted on at least one retainer rod with spacer sleeves fitting over the rod and abutting the pump to hold it in place.

* * * * *